US006325704B1

(12) United States Patent
Brown et al.

(10) Patent No.: US 6,325,704 B1
(45) Date of Patent: Dec. 4, 2001

(54) METHOD FOR FINISHING EDGES OF GLASS SHEETS

(75) Inventors: James William Brown, Painted Post; Bruce Herbert Raeder, Horseheads, both of NY (US); Masayuki Shinkai, Shizuoka ken (JP)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/333,133

(22) Filed: Jun. 14, 1999

(51) Int. Cl.[7] ..... B24B 1/00
(52) U.S. Cl. ..... 451/44; 451/57
(58) Field of Search ..... 451/41, 44, 57, 451/261, 262

(56) References Cited

U.S. PATENT DOCUMENTS

| | | | | |
|---|---|---|---|---|
| 2,022,530 | * | 11/1935 | White | 451/44 |
| 3,111,790 | * | 11/1963 | Vegors et al. | 451/256 |
| 5,146,715 | * | 9/1992 | Bando | 451/44 |
| 5,185,959 | * | 2/1993 | Ikola et al. | 451/44 |
| 5,295,331 | * | 3/1994 | Honda et al. | 451/44 |
| 5,409,417 | * | 4/1995 | Bando | 451/44 |
| 5,545,277 | * | 8/1996 | Hashemi et al. | 451/44 |
| 5,622,540 | | 4/1997 | Stevens . | |
| 5,658,189 | * | 8/1997 | Kagamida | 451/44 |
| 5,674,110 | * | 10/1997 | Cuoghi | 451/44 |
| 5,727,990 | * | 3/1998 | Hasegawa et al. | 451/44 |
| 5,816,897 | * | 10/1998 | Raeder et al. | 451/44 |
| 5,975,992 | * | 11/1999 | Raeder et al. | 451/44 |
| 6,091,078 | * | 7/2000 | Codama | 257/40 |

FOREIGN PATENT DOCUMENTS

| | | | |
|---|---|---|---|
| 85 03 914 U1 | 7/1985 | (DE) . | |
| 0 759 339 A1 | 2/1997 | (EP) | B24B/9/00 |
| 0 687 524 A1 | 12/1995 | (EP) | B24B/9/06 |
| 63102860 | 7/1988 | (JP) | B24B/9/00 |
| 11151646 | 8/1999 | (JP) | B24B/9/00 |
| 11151647 | 8/1999 | (JP) | B24B/9/08 |

* cited by examiner

*Primary Examiner*—M. Rachuba
(74) *Attorney, Agent, or Firm*—Angela N. Nwaneri; Maurice M. Klee; Silvy A. Murphy

(57) ABSTRACT

A method for edge finishing glass sheets. Glass sheets are separated into desired sizes, after which the edges of the glass sheets are finished using first grinding wheels to grind the edges, followed by polishing wheels to round off the ground edges by contacting and moving the edges of the glass sheet against stationary rotating grinding and polishing wheels which are each oriented approximately parallel to the major surface of the glass sheet.

4 Claims, 3 Drawing Sheets

METHOD FOR FINISHING EDGES OF GLASS SHEETS

FIELD OF THE INVENTION

The invention relates to a method and apparatus for finishing the edges of glass sheets, particularly sheets for use in flat panel displays.

BACKGROUND OF THE INVENTION

The manufacturing process of flat panel display substrates requires specific sized glass substrates capable of being processed in standard production equipment. The sizing techniques typically employ a mechanical scoring and breaking process in which a diamond or carbide scoring wheel is dragged across the glass surface to mechanically score the glass sheet, after which the glass sheet is bent along this score line to break the glass sheet, thereby forming a break edge. Such mechanical scoring and breaking techniques commonly result in lateral cracks about 100 to 150 microns long, which emanate from the score wheel cutting line. These lateral cracks decrease the strength of the glass sheet and are thus removed by grinding the sharp edges of the glass sheet. The sharp edges of the glass sheet are ground by a metal grinding wheel having a radiused groove on its outer periphery, with diamond particles embedded in the radiused groove. By orienting the glass sheet against the radiused groove, and by moving the glass sheet against this radiused groove and rotating the diamond wheel at a high RPM (revolutions per minute), a radius is literally ground into the edge of the glass sheet. However, such grinding methods involve removal of about 100 to 200 microns or more of the glass edge. Consequently, the mechanical scoring step followed with the diamond wheel grinding step creates an enormous amount of debris and particles.

In addition, in spite of repeated washing steps, particles generated during edge finishing continue to be a problem. For example, in some cases particle counts from the edges of glass sheets prior to shipping were actually lower than subsequent particle counts taken after shipping. This is because the grinding of the glass sheets resulted in chips, checks, and subsurface fractures along the edges of the ground surfaces, all of which serve as receptacles for particles. These particles subsequently would break loose at a later time, causing contamination, scratches, and sometimes act as a break source in later processing. Consequently, such ground surfaces are "active", meaning subject to expelling particles with environmental factors, such as, temperature and humidity. The present invention relates to methods for reducing these "lateral cracks" and "micro-checking" caused by grinding, thereby forming a glass sheet having edges that are more "inactive".

Laser scoring techniques can greatly reduce lateral cracking caused by conventional mechanical scoring. Previously, such laser scoring methods were thought to be too slow and not suitable for production manufacturing finishing lines. However, recent advances have potentially enabled the use of such methods in production glass finishing applications. Laser scoring typically starts with a mechanical check placed at the edge of the glass. A laser with a shaped output beam is then run over the check and along a path on the glass surface causing an expansion on the glass surface, followed by a coolant quench to put the surface in tension, thereby thermally propagating a crack across the glass in the path of travel of the laser. Such heating is a localized surface phenomenon. The coolant directed behind the laser causes a controlled splitting. Stress equilibrium in the glass arrests the depth of the crack from going all the way through, thereby resulting in a "score-like" continuous crack, absent of lateral cracking. Such laser scoring techniques are described, for example, in U.S. Pat. Nos. 5,622,540 and 5,776,220 which are hereby incorporated by reference.

Unfortunately, unbeveled edges formed by laser scoring are not as durable as beveled edges, due to the sharp edges produced during the laser scoring process. Thus, the sharp edges still have to be ground or polished as described herein above. An alternative process has been to grind the edges with a polishing wheel made from a soft material, such as, a polymer, in order to smooth out the flat sharp edges formed by the scoring process. However, the polishing process often gives rise to a phenomenon that is known in the industry as an "edge roll", where during the finishing of an edge having a flat surface, the surface tends to roll over and form an associated radius.

In light of the foregoing, it is desirable to design a process to finish an edge of a glass sheet that curbs prospective chips, checks and subsurface fractures along the edge. Also, it is desirable to provide a process that allows a smaller amount of glass removal and yet maintain the edge quality. Furthermore, it is desirable to design a process that increases the speed of finishing an edge of a glass without degrading the desired strength and edge quality attributes of the glass. Also, it is desirable to provide a technique that provides an edge without blended radiuses.

SUMMARY OF THE INVENTION

The present invention relates to a method for finishing the edges of glass sheets comprising the steps of chamfering the top and bottom of each of the edges of the glass sheet to form chamfered planes while reducing the overall width of each of the edges by not more than 35 microns, and where the angle between each of the chamfered planes and the adjacent major surface of the glass sheet is less than 40 degrees, preferably approximately 30 degrees. The method further comprises rounding each edge formed by the intersection of each of the chamfered planes and the original edge of the glass sheet. One such embodiment involves moving the edges of the glass sheet over at least one rotating grinding wheel having at least one v-shaped groove in the grinding surface and one rotating polishing wheel having a flat polishing surface, each of the grinding and polishing surfaces being oriented such that each of the grinding and polishing wheels are parallel to the major plane of the glass sheet. In a preferred embodiment, the v-shaped groove in the grinding surface of the grinding wheel is embedded with diamond particles, whereas the polishing surface of the polishing wheel is sufficiently soft so that formation of a concave beveled edge is avoided. Also, a preferred embodiment, each of the grinding wheels have a surface speed that is greater than the surface speed of each of the polishing wheels.

DETAILED DESCRIPTION OF THE INVENTION

Figure 1:
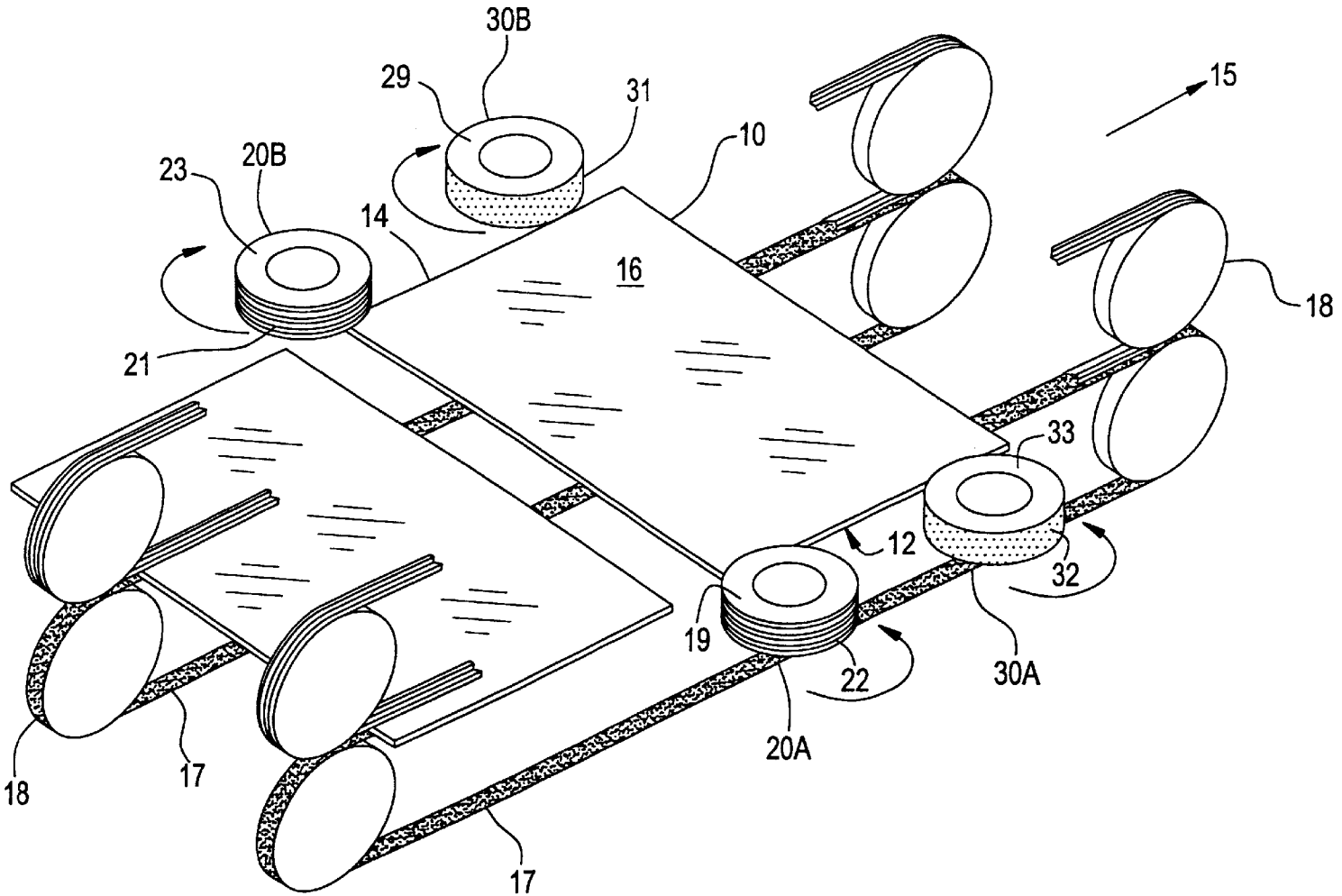
FIG. 1 illustrates a perspective view of a process in accordance with the present invention.

The present invention generally provides a method for grinding and polishing the edges of a sheet of glass, in particular, a flat panel display glass sheet. According to the present invention, the sheet of glass is held in place by securing means and the sheet of glass is conveyed on a conveyer system as shown in FIG. 1. FIG. 1 illustrates a preferred embodiment of the invention in which a plurality of grinding wheels and polishing wheels are used to finish the edges of a glass sheet. FIG. 1 shows a glass sheet designated generally by reference numeral 10 being conveyed on a conveyer system in the direction of arrow 15 while at least one edge of the glass sheet 10 is being ground and polished by the set of grinding wheels 20A and 20B and polishing wheels 30A and 30B. The major surface 19 and 23 of each of the grinding wheels 20A and 20B, respectively, and the major surface 33 and 29 of each of the polishing wheels 30A and 30B, respectively, are positioned parallel to the major surface 16 of the glass sheet 10. In the embodiment shown in FIG. 1, the grinding wheels 20A and 20B, each rotate in opposite directions. Specifically, grinding wheel 20A rotates in a counterclockwise direction, whereas grinding wheel 20B rotates in a clockwise direction. Similarly, polishing wheels 30A and 30B each rotate in opposite directions. Specifically, polishing wheel 30A rotates in a counterclockwise direction, whereas polishing wheel 30B rotates in a clockwise direction.

As shown in FIG. 1, the grinding surface 21 of the grinding wheel 20B contacts one of the edges 14 of the glass sheet 10, whereas the grinding surface 22 of the grinding wheel 20A contacts an opposite edge 12 of the glass sheet 10. Similarly, the polishing surface 32 of the polishing wheel 30A contacts the edge 12 of glass sheet 10, whereas the polishing surface 31 of the polishing wheel 30B contacts the edge 14 of the glass sheet 10. In the preferred embodiment, each of the grinding wheels 20A and 20B and each of the polishing wheels 30A and 30B rotate simultaneously. Moreover, opposing edges 12 and 14 are simultaneously ground and polished in the preferred embodiment. In particular, each of the edges 12 and 14 first contact the grinding surfaces 22 and 21 of the grinding wheels 20A and 20B, respectively, and then the ground edges next contact the polishing surfaces 32 and 31 of each of the polishing wheels 30A and 30B, respectively. Also, as shown in FIG. 1, each of the grinding wheels 20A and 20B are spaced apart from each of the polishing wheels 30A and 30B, with grinding wheel 20A and polishing wheel 30A being positioned proximate to each other on one edge 12 of the glass sheet 10, and with grinding wheel 30A and polishing wheel 30B being positioned proximate to each other on the other edge 14 of the glass sheet 10.

Figure 2A:
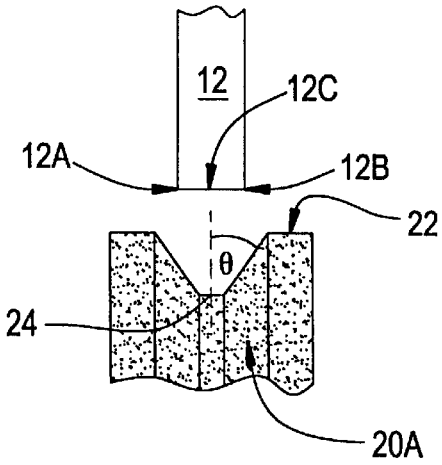
FIG. 2A illustrates a partial cross-sectional view illustrating the grinding process illustrated in FIG. 1.
Figure 2B:
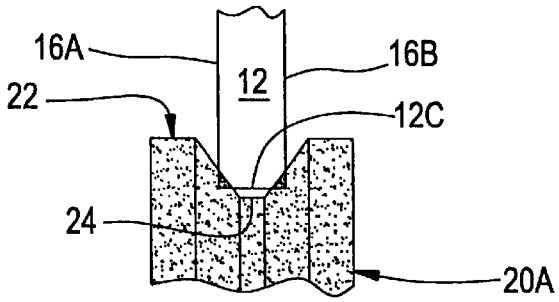
FIG. 2B illustrates a partial cross-sectional view of the grinding process illustrated in FIG. 1.
Figure 2C:
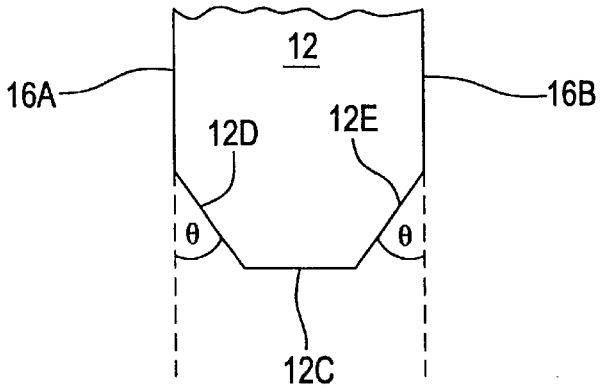
FIG. 2C illustrates a partial cross-sectional view of the grinding process illustrated in FIG. 1.
Figure 3A:
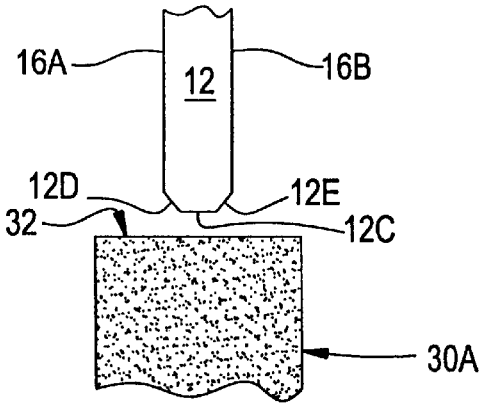
FIG. 3A illustrates a partial cross-sectional view of the polishing process illustrated in FIG. 1.
Figure 3B:
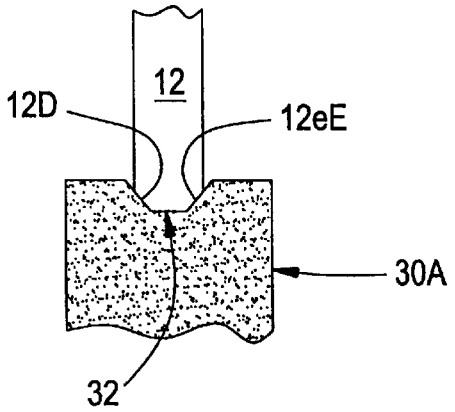
FIG. 3B illustrates a partial cross-sectional view of the polishing process illustrated in FIG. 1.
Figure 3C:
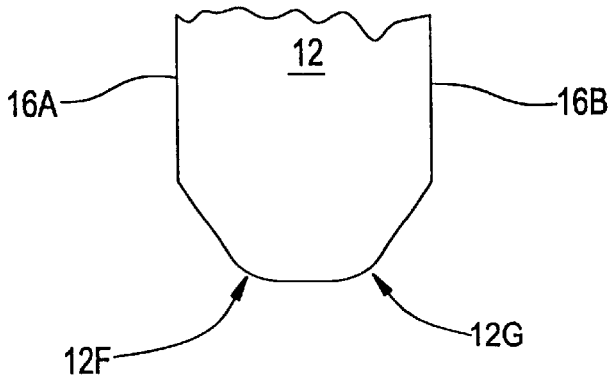
FIG. 3C illustrates a partial cross-sectional view of the polishing process illustrated in FIG. 1.

Furthermore, in the preferred embodiment, each of the grinding wheels 20A and 20B and each of the polishing wheels 30A and 30B are stationary, whereas, the glass sheet 10 is moved in the direction of arrow 15, so that each of the edges 12 and 14 are first ground and then polished. FIGS. 2A–2C show the details of one of the edges 12 being ground, whereas, FIGS. 3A–3C show details of the edge 12 being polished after the edge 12 has been ground. FIG. 2A shows a partial cross-sectional view of the grinding surface 22 of the grinding wheel 20A. As shown, the grinding surface 22 has at least one V-shaped groove 24 on the outer periphery, where a radial line passing through the center of the V-shaped groove 24 forms an angle θ with the V-shaped groove 24. The angle θ is in a preferred embodiment approximately between 15 and 40 degrees, most preferably, approximately 30 degrees. Although FIG. 2A shows only a single V-shaped groove 24, as shown in FIG. 1, the grinding wheels 20A and 20B each can have a plurality of V-shaped grooves 24, and in a preferred embodiment, each of the grinding wheels 20A and 20B have six V-shaped grooves 24. As shown in FIG. 2A, the edge 12 of the glass sheet 10 is aligned with the V-shaped groove 24. Specifically, the edge 12 has a flat region 12C located between a pair of corner regions 12A and 12B respectively. As shown in FIG. 2B, the edge 12 is inserted into the V-shaped groove 24 such that only the pair of comer regions 12A and 12B contact the V-shaped groove 24, whereas, the middle portion of the flat region 12C does not contact the grinding surface 22 of the grinding wheel 20A. As the comer regions 12A and 12B are chamfered by the V-shaped groove 24, the pair of comer regions 12A and 12B are transformed into a pair of ground beveled regions 12D and 12E, respectively, as shown in FIG. 2C. Also as shown in FIG. 2C, each of the rounded beveled regions 12D and 12E form an angle θ with the top surface 16A and the bottom surface 16B, respectively, of the glass sheet 10. In a preferred embodiment, the angle θ is approximately between 15 and 40 degrees, and most preferably, approximately 30 degrees. As shown in FIG. 2C, the middle portion of the flat region 12C of the edge 12 remains the same shape as before grinding, since this portion of the edge 12 is not contacted by the grinding wheel 20A.

The ground edge 12 next contacts the polishing surface 32 of polishing wheel 30A, as shown in FIG. 3A. As shown in FIG. 3A, the polishing surface 32 of polishing wheel 30A is substantially flat. Furthermore, the polishing surface 32 is sufficiently soft so that formation of a concave beveled edge on the edge 12 is avoided. As shown in FIG. 3B, as the ground edge 12 contacts the polishing surface 32 of the polishing wheel 30A, the polishing surface 32 becomes depressed in conformity with the shape of the ground edge 12. In this manner, each of the sharp interfaces that the ground beveled regions 12D and 12E form with the flat region 12C is substantially rounded, as represented by 12F and 12G shown in FIG. 3C. The edge 14 of glass sheet 10 is rounded and polished simultaneously with edge 12 in a similar manner as described herein above, but instead with grinding wheel 20B and polishing wheel 30B.

In another aspect, the invention provides a method of finishing an edge 12 of a glass sheet 10 having a thickness not greater than approximately 3 mm. The method comprises the steps of chamfering the top surface 16A and the bottom surface 16B of the edge 12 of the glass sheet 10 to form chamfered planes 12D and 12E while reducing the overall width of the edge 12 by not more than approximately 35 microns. Moreover, the angle θ between each of the chamfered planes 12D and 12E and the adjacent major surfaces 16A and 16B of the glass sheet 10 is approximately less than 40 degrees. The method further comprises the step of next rounding the edge 12 formed by the intersection of each of the chamfered planes 12D and 12E, and the original edge 12C of the glass sheet 10. The chamfering step comprises contacting the top surface 16A and the bottom surface 16B of the edge 12 of the glass sheet 10 with at least one rotating grinding wheel 20A that has a grinding surface 22 with at least one V-shaped groove 24, where the grinding surface 22 is parallel to the major surface 16 of the glass sheet 10. Furthermore, the rounding step comprises contacting the top surface 16A and the bottom surface 16B of the edge 12 having chamfered planes 12D and 12E with at least one rotating polishing wheel 30A that has a polishing surface 32 that is sufficiently soft so that formation of a concave chamfer on the edge 12 is avoided. The angle θ formed by each of the chamfered planes 12D and 12E with the adjacent top surface 16A and the bottom surface 16B of the glass sheet 10 is preferably approximately 30 degrees each.

Accordingly, the edge finishing process of the present invention removes not more than approximately 35 microns from each edge of the glass sheet, which improves the strength of the glass sheet as well as the edge quality since less micro cracks are generated in the process. Moreover, the angle θ formed by each of the chamfered planes is preferably approximately 30 degrees, which takes into account any lateral shifts of the glass sheet due to the grinding equipment conveying inaccuracies.

The finishing method further comprises first conveying the glass sheet 10 on a conveyer system that includes a plurality of wheels 18 (shown in FIG. 1). The conveyor system conveys the glass sheet 10 between each of the rotating grinding wheels 20A and 20B and each of the rotating polishing wheels 30A and 30B. Furthermore, the conveying step includes securing glass sheet 10 onto the conveyer system by a set of belts 17 that are partially shown in FIG. 1. The conveying step further includes first cutting the glass sheet 10 to size by forming at least a partial crack in the glass sheet 10 along a desired line of separation, and leading the crack across the glass sheet 10 by localized heating by a laser, and moving the laser across the sheet to thereby lead the partial crack and form a second partial crack in the desired line of separation and breaking the glass sheet 10 along the partial crack. Preferably, the grinding wheels 20A and 20B rotate faster than the polishing wheels 30A and 30B. In a preferred embodiment, each of the grinding wheels rotate at approximately 2,850 RPMs, whereas each of the polishing wheels rotate at approximately 2,400 RPMs. Moreover, the surface speed of each of the grinding wheels 20A and 20B is greater than the surface speed of each of the polishing wheels 30A and 30B. Also, in a preferred embodiment, the glass sheet 10 is conveyed at a feed rate of approximately 4.5 to 6 meters per minute. In a preferred embodiment, the diameter of each of the grinding wheels 20A and 20B is less than or equal to the diameter of each of the polishing wheels 30A and 30B.

In a preferred embodiment, the grinding wheels 20A and 20B employed in the invention are metal bonded grinding wheels, each having six recessed grooves, each of the grooves being embedded with diamond particles. The diamond particles have a grit size in the range of approximately 400 to 800, preferably about 400. Further, each of the grooves of the grinding wheels 20A and 20B employed in the invention are approximately 0.7 mm wide. Moreover, preferably, the grinding wheels 20A and 20B each have a diameter of 9.84 inches and a thickness of about one inch. The glass sheet 10 is conveyed at a feed rate of 4.5 to 6 meters per minute. Further, the surface speed of each of the grinding wheels 20A and 20B is approximately 7,338 sfpm (surface feet per minute), whereas, the surface speed of each of the polishing wheels 30A and 30B is approximately 5,024 sfpm. The polishing wheels 30A and 30B employed in the invention each comprise an abrasive media dispersed within a suitable carrier material, such, as a polymeric material. The abrasive media may be selected, for example, from the group consisting of $Al_2O_3$; SiC, pumice, or garnet abrasive materials. Preferably, the particle size of the abrasive media is equal to or finer than 220 grit, more preferably equal to or finer than 180 grit. Examples of suitable abrasive polishing wheels of this sort are described, for example, in U.S. Pat. No. 5,273,558, the specification of which is hereby incorporated by reference. Examples of suitable polymeric carrier materials are butyl rubber, silicone, polyurethane, natural rubber. One preferred family of polishing wheels for use in this particular embodiment are the XI-737 grinding wheels available from Minnesota Mining and Manufacturing Company, St. Paul, Minn. Suitable polishing wheels may be obtained, for example, from Cratex Manufacturing Co., Inc., located at 7754 Arjons Drive, San Diego, Calif.; or The Norton Company, located in Worcester, Mass. In addition the preferable diameter of each of the polishing wheels 30A and 30B is approximately 8.0 inches and the thickness is about one inch.

Although the invention has been described in detail for the purpose of illustration, it is understood that such detail is solely for that purpose and variations can be made therein by those skilled in the art without departing from the spirit and scope of the invention which is defined by the following claims.

What is claimed is:

1. A method of finishing an edge of a glass sheet having a thickness not greater than 3 mm, comprising the steps of:

chamfering the top and bottom of said edge of said sheet to form chamfered planes while reducing the overall width of said edge by not more than 35 microns, the angle between each of said chamfered planes and the adjacent major surface of said sheet being less than 40 degrees; and rounding each edge formed by the intersection of each of said chamfered planes and the original edge of said glass sheet;

wherein:

(a) said chamfering step comprises contacting the top and bottom of said edge of said sheet with at least one rotating grinding wheel that has a grinding surface with at least one v-shaped groove, said grinding wheel being parallel to the major surface of said glass sheet; and (b) said rounding step comprises contacting the top and bottom of said edge having chamfered planes with at least one rotating polishing wheel that has a polishing surface that is sufficiently soft so that formation of a concave chamfer on said edge is avoided.

2. The method of claim 1, wherein the angle between each of said chamfered planes and the adjacent major surface of said sheet is approximately 30 degrees.

3. The method of claim 1, wherein the rotational speed of each of said grinding wheels is faster than the rotational speed of each of said polishing wheels.

4. The method of claim 1, wherein the surface speed of each of said grinding wheels is faster than the surface speed of each of said polishing wheels.

* * * * *